US007253698B2

(12) United States Patent
Saitoh

(10) Patent No.: US 7,253,698 B2
(45) Date of Patent: Aug. 7, 2007

(54) LINE CONVERTER FOR COUPLING STANDING WAVES TO A SHIELD AREA OF A THREE DIMENSIONAL WAVEGUIDE

(75) Inventor: Atsushi Saitoh, Muko (JP)
(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/526,105

(22) PCT Filed: Jul. 25, 2003

(86) PCT No.: PCT/JP03/09420

§ 371 (c)(1),
(2), (4) Date: Jul. 22, 2005

(87) PCT Pub. No.: WO2004/021505

PCT Pub. Date: Mar. 11, 2004

(65) Prior Publication Data

US 2005/0285694 A1 Dec. 29, 2005

(30) Foreign Application Priority Data

Aug. 27, 2002 (JP) ..... 2002-247556
Jul. 7, 2003 (JP) ..... 2003-193156

(51) Int. Cl.
*H01P 5/107* (2006.01)

(52) U.S. Cl. ..... 333/26; 333/248

(58) Field of Classification Search ..... 333/26, 333/248

See application file for complete search history.

(56) References Cited

U.S. PATENT DOCUMENTS 4,550,296 A 10/1985 Ehrlinger et al.

(Continued)

FOREIGN PATENT DOCUMENTS

DE 3019523 A1 11/1981

(Continued)

OTHER PUBLICATIONS

Official Communication issued in corresponding Chinese Patent Application No. 03820340.5, dated Jul. 14, 2006.

(Continued)

*Primary Examiner*—Benny Lee
(74) *Attorney, Agent, or Firm*—Keating & Bennett, LLP

(57) ABSTRACT

A line converter includes ground conductors, a transmission-line conductor and a coupling-line conductor disposed on a dielectric substrate. A dielectric-filled waveguide includes a lower conductor plate, an upper conductor plate, a lower dielectric strip, and an upper dielectric strip, where the dielectric substrate is sandwiched between the lower conductor plate and the lower dielectric strip, and the upper conductor plate and the upper conductor strip, so that a conductor portion S that is part of the ground conductors of the dielectric substrate defines a shield area of the dielectric-filled waveguide. The coupling-line conductor is coupled to a standing wave generated by the shield area, at a position where the electric-field intensity of the standing wave is high. Subsequently, a plane circuit can be arranged so as to be substantially parallel to the direction in which an electromagnetic wave propagates through the three-dimensional waveguide. Further, the dielectric substrate can be easily machined and the characteristic of coupling between the plane circuit and the three-dimensional waveguide provided on the dielectric substrate is prevented from being affected by the precision of assembling the plane circuit and the three-dimensional waveguide so that a line-conversion characteristic according to a predetermined design can be easily obtained.

11 Claims, 7 Drawing Sheets

U.S. PATENT DOCUMENTS

| | | | | |
|---|---|---|---|---|
| 5,770,989 | A * | 6/1998 | Ishikawa et al. | 333/248 |
| 6,384,694 | B1 | 5/2002 | Tanizaki et al. | |

FOREIGN PATENT DOCUMENTS

| | | | |
|---|---|---|---|
| DE | 3217945 | A1 | 2/1984 |
| JP | 60-192401 | | 9/1985 |
| JP | 04-271501 | A | 9/1992 |
| JP | 2000-134008 | A | 5/2000 |
| JP | 2001-111310 | | 4/2001 |
| JP | 2001-160703 | | 6/2001 |
| JP | 10-215104 | | 8/2001 |
| JP | 2002-135012 | | 5/2002 |
| JP | 2003-133815 | | 5/2003 |

OTHER PUBLICATIONS

Official Communication issued in corresponding European Patent Application No. 03 791 183.1-1248, dated Aug. 24, 2006.

Official communication issued in the corresponding Chinese Application No. 03820340.5, mailed on Mar. 2, 2007.

Konishi, "Basics and Application of Microwave Circuit," pp. 215-216 of (1990, Sougou Denshi Shuppansha).

Official communication issued in the counterpart Japanese Application No. 2003-193156, mailed on Feb. 20, 2007.

* cited by examiner

LINE CONVERTER FOR COUPLING STANDING WAVES TO A SHIELD AREA OF A THREE DIMENSIONAL WAVEGUIDE

BACKGROUND OF THE INVENTION

1. Field of the Invention

The present invention relates to a line converter for a transmission line used for at least one of a microwave band and a millimeter-wave band, for example, a high-frequency module including the line converter, and a communication device.

2. Description of the Related Art

In the past, line converters for performing line conversion between a plane circuit including a dielectric substrate and a three-dimensional waveguide for propagating an electromagnetic wave in a three-dimensional space have been disclosed in Patent Document 1 (Japanese Unexamined Patent Application Publication No. 60-192401) and Patent Document 2 (Japanese Unexamined Patent Application Publication No. 2001-111310).

In the line converter according to Patent Document 1, an end of a micro-strip line formed as part of the plane circuit is inserted in a terminal short-circuit waveguide tube divided into two parts by a plane E of the waveguide tube. The two parts of the terminal short-circuit waveguide tube penetrate a groove formed in the dielectric substrate and sandwich the dielectric substrate therebetween.

In the line converter according to Patent Document 2, the dielectric substrate is provided at a position that is spaced away from a short-circuit plane of a terminal short-circuit waveguide tube by as much as a predetermined distance and in a predetermined direction that is perpendicular to the electromagnetic-wave propagation direction.

In the case of the line converter of Patent Document 1, there is a need to form a penetrating groove in the dielectric substrate, so as to penetrate part of the waveguide tube divided into two parts. Therefore, when the dielectric substrate is formed as a ceramic substrate including alumina or the like, it becomes difficult to machine the dielectric substrate. Further, coupling of the micro-strip line is achieved at a position where the intensity of electric fields generated by a standing wave generated at a terminal end of the waveguide is high. The coupling characteristic is determined by the positional relationship between the dielectric substrate including the micro-strip line and the waveguide tube. Therefore, the coupling characteristic is affected by the precision of assembling the dielectric substrate and the waveguide tube, which makes it difficult to obtain a line-conversion characteristic according to a predetermined design without variations.

In the line converter according to Patent Document 2, the dielectric substrate is provided in a predetermined direction that is perpendicular to the electromagnetic-wave propagation direction of the waveguide tube. Therefore, the positional relationship between the three-dimensional waveguide formed by the waveguide tube and the plane circuit formed by the dielectric substrate is determined with a low degree of flexibility. Subsequently, the plane circuit cannot be provided in a predetermined direction that is parallel to the electromagnetic-wave propagation direction of the waveguide tube.

SUMMARY OF THE INVENTION

In order to overcome the problems described above, preferred embodiments of the present invention provide a line converter wherein a plane circuit can be arranged in a predetermined direction that is substantially parallel to the direction in which an electromagnetic wave propagates through a three-dimensional waveguide, a dielectric substrate can be easily machined, and the characteristic of coupling between the plane circuit provided on the dielectric substrate and the three-dimensional waveguide is prevented from being affected by the precision of assembling the plane circuit and the three-dimensional waveguide so that a line-conversion characteristic according to a predetermined design can be easily obtained. The preferred embodiments of the present invention also provide a high-frequency module including such a unique line converter, and a communication device.

According to a preferred embodiment of the present invention, a line converter includes a three-dimensional waveguide for propagating an electromagnetic wave in a three-dimensional space and a plane circuit having a predetermined conductor pattern disposed on a dielectric substrate, so as to perform line conversion between the plane circuit and the three-dimensional waveguide.

The line converter is characterized in that the dielectric substrate is arranged so as to be substantially parallel to a plane E of the three-dimensional waveguide and at an approximately central portion of the three-dimensional waveguide, and the conductor pattern of the dielectric substrate includes a conductor portion defining a shield area of the three-dimensional waveguide, a coupling-line portion that is electromagnetically coupled to a standing wave that occurs in the shield area, and a transmission-line portion continuing from the coupling-line portion.

Thus, a standing wave required for electromagnetically coupling the three-dimensional waveguide to the transmission line on the plane circuit is generated by the shield area defined by the conductor portion provided on the dielectric substrate. Therefore, the positional relationship between the conductor portion on the dielectric-substrate side defining the shield area of the three-dimensional waveguide and the coupling-line portion that is electromagnetically-coupled to the standing wave generated at the shield area is determined only by the precision of forming the conductor pattern on the dielectric substrate. Subsequently, a stable coupling characteristic can be obtained without being affected by the precision of assembling the three-dimensional waveguide and the plane circuit, and a line-conversion characteristic according to a predetermined design can be obtained.

Further, preferred embodiments of the present invention are also characterized in that the conductor portion defining the shield area includes ground conductors disposed on both surfaces of the dielectric substrate.

Further, preferred embodiments of the present invention are additionally characterized by having a plurality of conduction paths that penetrates the dielectric substrate and that is aligned on at least one of both sides thereof, so as to be spaced away from the transmission line by as much as a predetermined distance, so that conduction is established between the ground conductors located on the both surfaces of the dielectric substrate.

Further, additional preferred embodiments of the present invention are characterized in that a conductor of the three-dimensional waveguide is divided into two portions including an upper portion and a lower portion by a plane that is substantially parallel to the E plane and a space is provided in the conductor of the three-dimensional waveguide, so as to create a choke defined by the space, where the space is provided at a position spaced away from the three-dimensional waveguide by as much as a predetermined distance, so as to be substantially parallel to an electromagnetic-wave propagation direction of the three-dimensional waveguide.

Further, other preferred embodiments of the present invention are characterized by including the line converter and a high-frequency circuit connected to each of the plane circuit and the three-dimensional waveguide of the line converter.

Further, according to another preferred embodiment of the present invention, a communication device includes the high-frequency module in a unit for transmitting and receiving an electromagnetic wave.

Other features, elements, steps, characteristics and advantages of the present invention will become more apparent from the following detailed description of preferred embodiments thereof with reference to the attached drawings.

DETAILED DESCRIPTION OF PREFERRED EMBODIMENTS

The configuration of a line converter according to a first preferred embodiment of the present invention will now be described with reference to FIGS. 1 to 5.

Figure 1C:
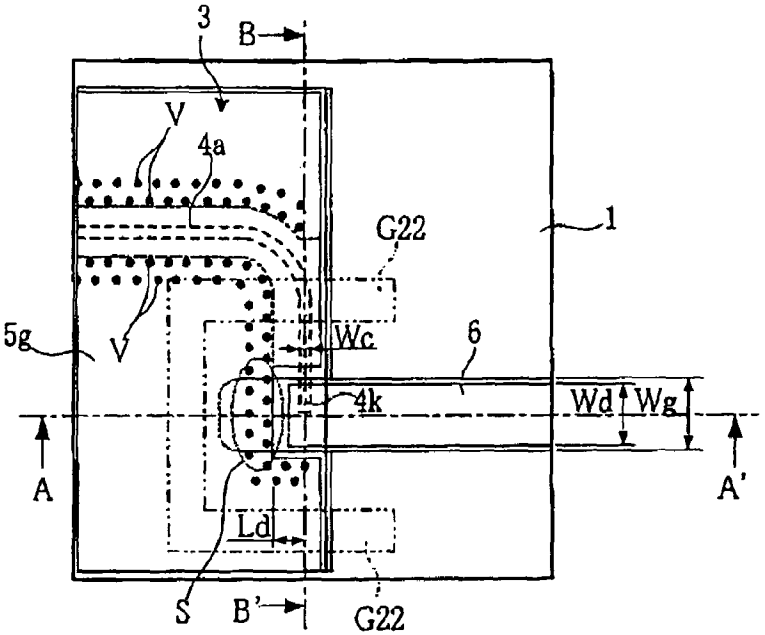
FIGS. 1(A)-1(C) show sectional views and a plan view of a line converter according to a first preferred embodiment of the present invention.
Figure 1B:
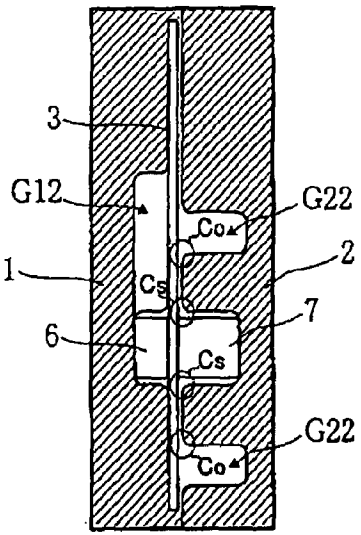
Figure 1A:
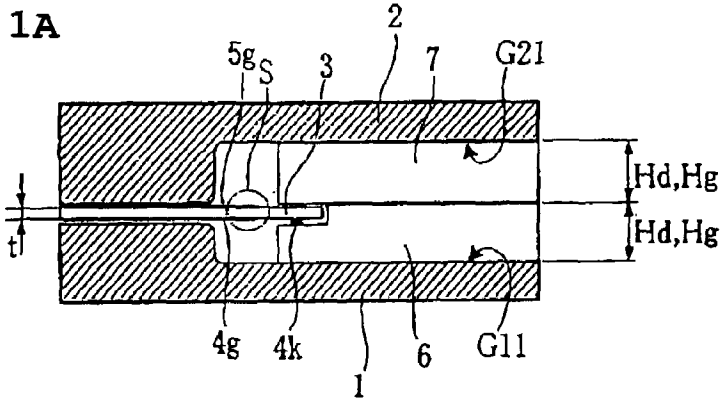

FIG. 1 shows the configuration of the line converter. FIG. 1(C) is a plan view showing the line converter after an upper conductor plate 2 and an upper dielectric strip 7 are removed therefrom. FIG. 1(A) is a sectional view along line A-A' of the line converter shown in FIG. 1(C), where the upper conductor plate 2 is mounted thereon. FIG. 1(B) is a sectional view along line B-B' of the line converter shown in FIG. 1(C), where the upper conductor plate 2 is mounted thereon, as in the case of FIG. 1(A).

Here, reference numeral 1 denotes a lower conductor plate, reference numeral 2 denotes the upper conductor plate, reference numeral 3 denotes a dielectric substrate, and reference numerals 6 and 7 denote dielectric strips. The dielectric substrate 3 is arranged so as to be sandwiched between the lower conductor plate 1 and the upper conductor plate 2, and the dielectric strips 6 and 7.

FIG. 2 shows exploded plan views illustrating the configuration of each portion of the line converter shown in FIG. 1. FIG. 2(A) shows the top surface of the upper conductor plate 2, FIG. 2(B) shows the top surface of the dielectric substrate 3, FIG. 2(C) shows a conductor pattern on the undersurface of the dielectric substrate 3, and FIG. 2(D) is a plan view of the lower conductor plate 1.

Figure 2A:
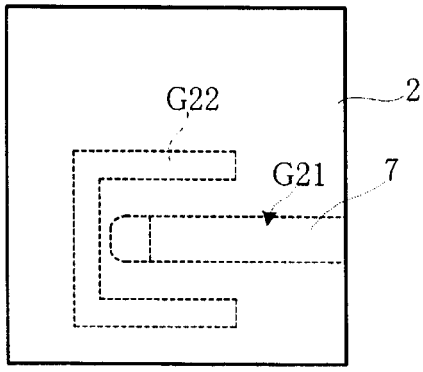
FIGS. 2(A)-2(D) show exploded plan views illustrating the line converter.
Figure 2B:
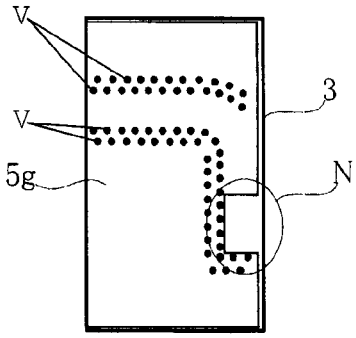
Figure 2C:
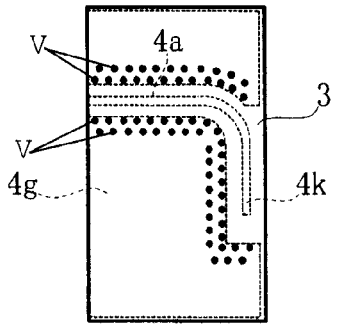
Figure 2D:
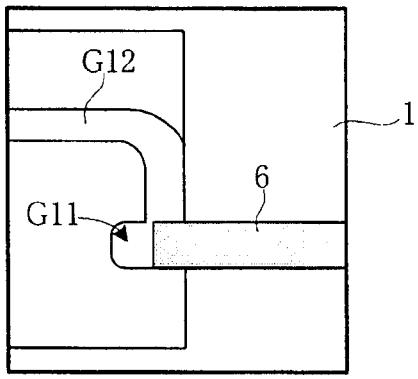

A three-dimensional-waveguide groove G11 is provided on the lower conductor plate 1 (FIG. 2(D)) and a three-dimensional-waveguide groove G21 is provided on the upper conductor plate 2. The lower dielectric strip 6 is inserted in the three-dimensional-waveguide groove G11 (FIG. 2(D)). The upper dielectric strip 7 is inserted in the three-dimensional-waveguide groove G21 (FIG. 2(A)). By overlaying the two conductor plates 1 and 2 one another, the two dielectric strips 6 and 7 are opposed to each other. Subsequently, a dielectric-filled waveguide (DFWG) (hereinafter simply referred to as a "waveguide") is formed.

A predetermined plane of the waveguide is determined to be an E plane (a conductor plane that is substantially parallel to the electric field of a TE10 mode that is the mode of a propagating electromagnetic wave), where the E plane is substantially parallel to the lower conductor plate 1 and the upper conductor plate 2. Therefore, the dielectric substrate 3 is provided at a position that is substantially parallel to the plane E of the waveguide and corresponding to the approximately central portion of the waveguide (the portion located between the lower conductor plate 1 and the upper conductor plate 2).

The conductor plates 1 and 2 are preferably formed by machining a metal plate including aluminum or other suitable material, for example. Further, the dielectric strips 6 and 7 are preferably formed by injection-molding or machining a fluoroplastic resin, for example. The dielectric substrate 3 is preferably formed by using a ceramic substrate including aluminum or other suitable material.

A transmission-line conductor 4*a* and a coupling-line conductor 4*k* continuing therefrom are provided on the undersurface of the dielectric substrate 3 (the side facing the lower conductor plate 1) (FIG. 2(C)). A ground conductor 5*g* is disposed on the top surface of the dielectric substrate 3 (the side facing the upper conductor plate 2) (FIG. 2(B)). The transmission-line conductor 4*a* located on the dielectric substrate 3 and the ground conductor 5*g* located on the surface facing the transmission-line conductor 4*a* define a micro-strip line.

A notch portion is provided in the ground conductor 5*g* on the top surface of the dielectric substrate 3, as indicated by reference character N shown in FIG. 2(B). The coupling-line conductor 4*k* facing the notch portion N, the dielectric substrate 3, the lower conductor plate 1, and the upper conductor plate 2 define a suspended line. The transmission-line conductor 4*a* and the coupling-line conductor 4*k* are disposed on the undersurface-side of the dielectric substrate 3 and the ground conductor 4*g* (FIG. 2(C)) is located in a predetermined area that is spaced away from the transmission lines by as much as a predetermined distance.

As shown in FIG. 2(D), the lower conductor plate 1 has a transmission-line groove G12 that is formed thereon and extends along the transmission line 4*a*. The transmission-line groove G12 provides a predetermined space on the hotline side of the micro-strip line and functions as a shield.

Further, a plurality of conduction paths (via holes) V for achieving continuity between the ground conductors 4*g* and 5*g* on the top surface and the undersurface of the dielectric substrate 3 is aligned on both sides of the transmission-line conductor 4*a* and the coupling-line conductor 4*k*, so as to be spaced away therefrom by as much as a predetermined distance. Subsequently, unnecessary coupling between a spurious mode such as a parallel-flat-plate mode generated between parallel flat plates, that is, the upper and lower ground conductors 4*g* and 5*g* sandwiching the dielectric substrate 3 therebetween and a micro-strip-line mode generated by the transmission-line conductor 4*a* and the ground conductor 5*g* is shielded. Further, unnecessary coupling between a suspended-line mode generated by the coupling-line conductor 4*k*, the dielectric substrate 3, and the conductor plates 1 and 2 and the spurious mode is shielded. Further, the conduction paths (via holes) V may be aligned on one side of the transmission-line conductor 4*a* and the coupling-line conductor 4*k*, so as to be spaced away therefrom by as much as a predetermined distance.

For sandwiching the dielectric substrate 3 having various conductor patterns disposed thereon between the two conductor plates 1 and 2 in the above-described manner, the dielectric substrate 3 is provided at a predetermined position with respect to the conductor plates 1 and 2 so that the coupling-line conductor 4*k* is inserted in the waveguide in a predetermined direction that is substantially perpendicular to the electromagnetic-propagation direction of the waveguide. The ground conductors 4*g* and 5*g* are arranged on the dielectric substrate 3 so that a portion of each of the ground conductors 4*g* and 5*g* is inserted in the waveguide. As shown in FIG. 1, a portion of the ground conductors 4*g* and 5*g* is designated by reference character S. This portion defines a shield area of the waveguide. That is to say, by arranging a ground conductor substantially parallel to the E plane at the approximately central portion of the waveguide, the waveguide is divided by the plane that is substantially parallel to the E plane, whereby the shield wavelength of the waveguide is reduced and the shield area is located in the waveguide. Specifically, the portion designated by reference character S functions as a conductor portion defining the shield area included in preferred embodiments of the present invention.

As shown in FIG. 2(A), the upper conductor plate 2 has a choke groove G22 that is substantially parallel to the electromagnetic-wave propagation direction of the waveguide and that is spaced away from the waveguide (from the three-dimensional-waveguide groove G21) by as much as a predetermined distance. Therefore, where the conductor plate 1 is placed on the upper conductor plate 2, a clearance generated at the interface defines a discontinuity portion. However, an electromagnetic wave that is likely to leak from the clearance is released in the space of the choke groove G22. Where the distance between a portion indicated by reference characters Co and a portion indicated by reference characters Cs corresponds to substantially one-fourth of a propagation wavelength in FIG. 1(B), the portion Co functions as an open end. Subsequently, the portion Cs equivalently functions, as a short-circuit end. Therefore, the radiation loss generated from the clearance created by the two conductor plates 1 and 2 placed on one another hardly occurs.

The positional relationship between the conductor portion S defining the shield area and the coupling-line conductor 4*k* depends on the dimensional precision of the conductor pattern with reference to the dielectric substrate 3. The forming precision of the conductor pattern with reference to the dielectric substrate is significantly higher than the assembly precision of the dielectric substrate 3 with reference to the conductors 1 and 2. Therefore, the relative position of a standing wave of the three-dimensional waveguide, where the standing wave occurs by the shield area, with respect to the coupling-line conductor 4*k* is maintained according to a predetermined design at all times. Subsequently, the characteristic of line-conversion between the waveguide and the plane circuit can be obtained according to the predetermined design at all times.

Next, the result of simulation performed for an example design will now be described according to FIGS. 3 to 5.

The design circumstances are as follows, for example:

Frequency: 76-GHz band

Width of the three-dimensional waveguide grooves G11 and G21(FIG. 1(C)): Wg=about 1.2 mm Depth of the three-dimensional waveguide grooves G11 and G21 (FIG. 1(A)): Hg=about 0.9 mm Dielectric constant of the dielectric strips 6 and 7: 2

Width of the dielectric strips 6 and 7(FIG. 1(C)): Wd=about 1.1 mm

Height of the dielectric strips 6 and 7(FIG. 1(A)): Hd=about 0.9 mm

Dielectric constant of the dielectric substrate 3(FIGS. 2(B) and 2(C)): 10

Figure 3:
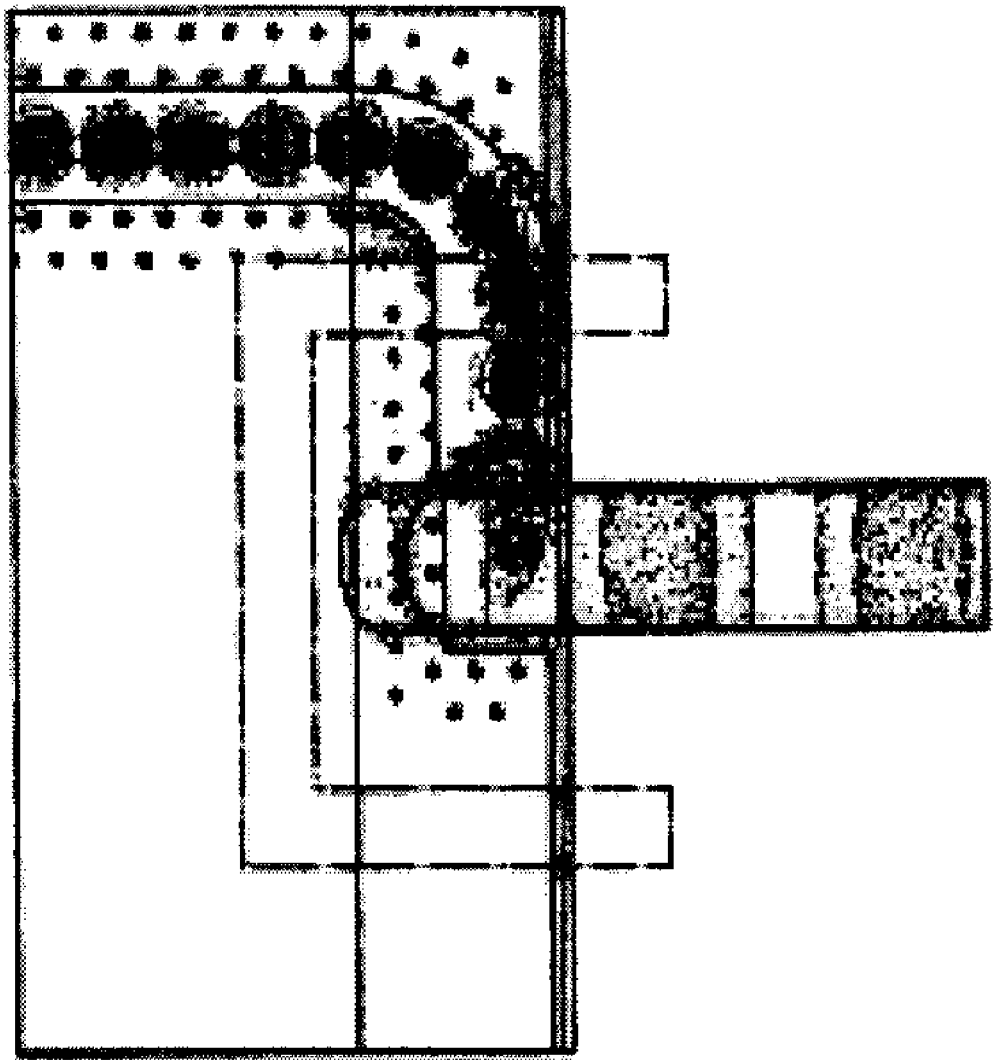
FIG. 3 is a sectional view showing an example electric-field intensity distribution of a three-dimensional waveguide illustrating the result of three-dimensional electromagnetic-field analysis simulation for the line converter.
Figure 4:
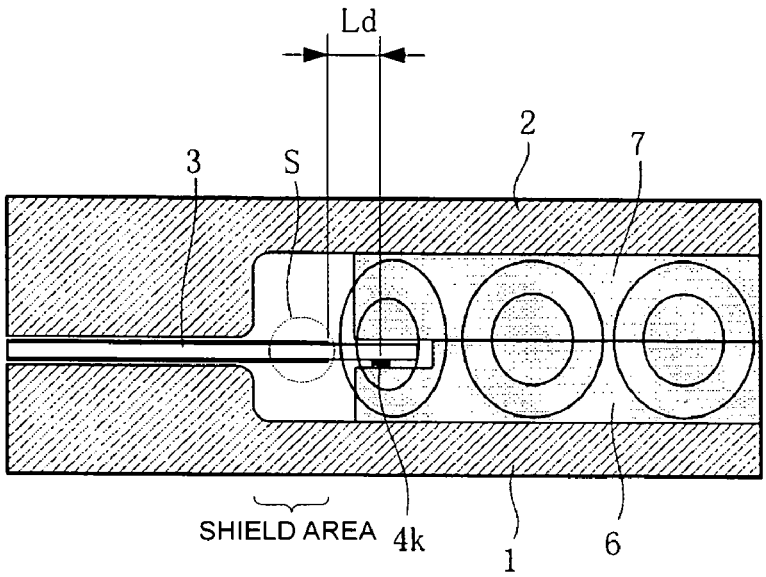
FIG. 4 is a plan view showing the result of three-dimensional electromagnetic-field analysis simulation for the line converter.

Thickness of the dielectric substrate 3(FIGS. 2(B) and 2(C)): t=about 0.2 mm Line width of the transmission-line conductor 4*a* and the coupling-line conductor 4*k(FIG.* 2*(C)):* Wc=about 0.2 mm FIG. 3 shows the result of three-dimensional electromagnetic-field analysis simulation illustrating line conversion between the waveguide and the plane circuit. Further, FIG. 4 shows a cross-sectional view of the waveguide portion. In FIG. 3, white and periodically shown patterns indicate the electric-field intensity distribution. In FIG. 4, ring-like patterns indicate the electric-field-intensity distribution. When comparing FIGS. 3, 4, 1(A), and 1(C) to one another, it is clear that the standing wave is generated by the waveguide-shield area defined by the conductor portion S and electromagnetically coupled to the suspended line defined by the coupled-connection conductor 4*k* at a position where the electric-field intensity of the standing wave increases to a maximum value. That is to say, a distance Ld (FIG. 4) between the conductor portion S defining the shield area and the coupling-line conductor 4*k* is determined so that the coupling-line conductor 4*k* is provided at a predetermined position where the electric-field distribution of the standing wave has a maximum value.

The generation of the above-described standing wave is affected by the positions of ends of the dielectric strips 6 and 7. Therefore, the distance between the ends of the dielectric strips 6 and 7, and the coupling-line conductor 4*k* is determined so that the coupling-line conductor 4*k* is provided at a position where the electric-field-intensity distribution of the standing wave has the maximum value. However, variations in the distance between the ends of the dielectric strips 6 and 7, and the coupling-line conductor 4*k* exert a relatively small influence on the standing-wave generation. Therefore, the assembly precision of the dielectric strips 6 and 7, and the dielectric substrate 3 with reference to the conductor plates 1 and 2 may be low.

The mode of the above-described suspended line is converted to the mode of the micro-strip line defined by the transmission-line conductor 4*a* so that electromagnetic waves are propagated in order.

Figure 5:
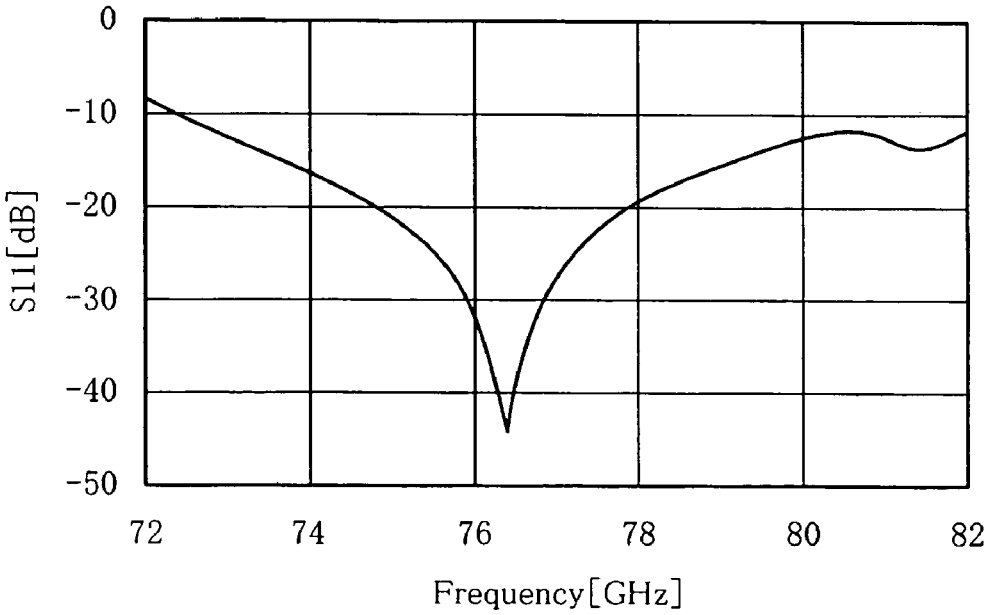
FIG. 5 is another plan view showing the result of three-dimensional electromagnetic-field analysis simulation for the line converter.

FIG. 5 shows the result of reflection characteristic S11 in the line-conversion portion. As shown in this drawing, a low-reflection characteristic of under about −40 dB is obtained in a 76-GHz band. Subsequently, it becomes possible to provide a line converter having high line-conversion efficiency.

Next, a line converter according to a second preferred embodiment of the present invention will be described with reference to FIGS. 6 and 7.

Figure 6C:
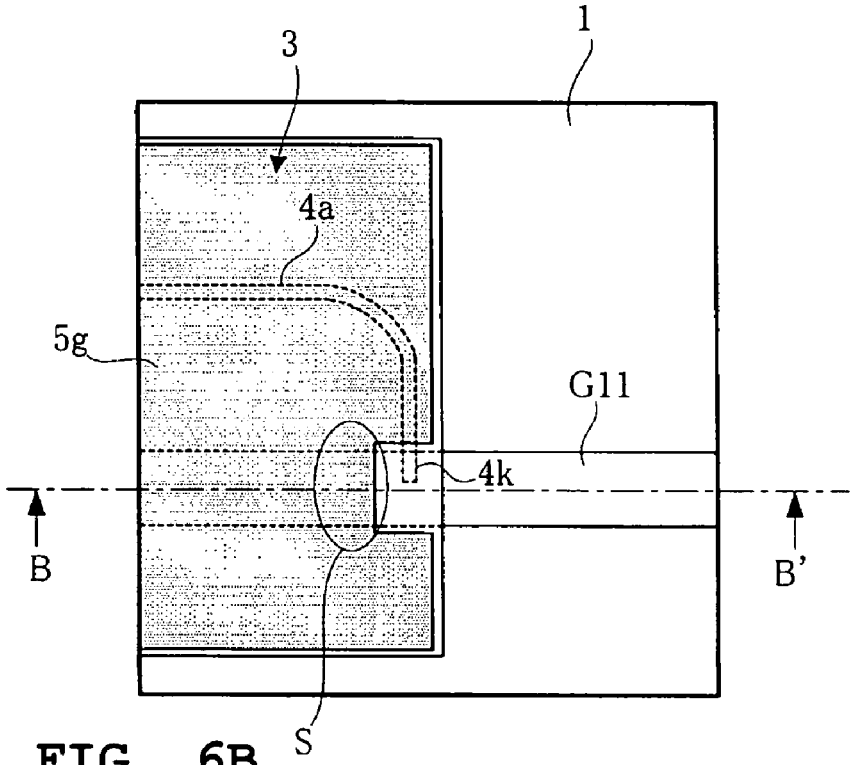
FIGS. 6(A)-6(C) illustrate a line converter according to a second preferred embodiment of the present invention.
Figure 6A:
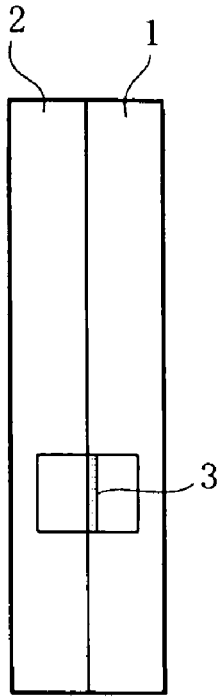
Figure 6B:
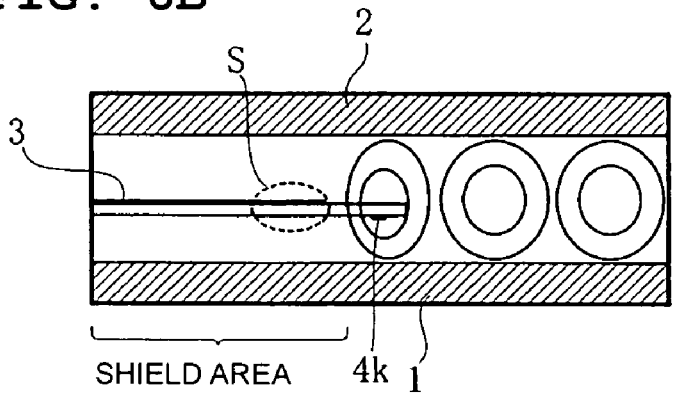

The line converter according to the second preferred embodiment performs line conversion between a hollow rectangular waveguide tube and a plane circuit. FIG. 6(C) is a plan view of the line converter after an upper conductor plate is removed therefrom. FIG. 6(A) is a right-side elevational view of the line converter, where the upper conductor plate is mounted thereon, and FIG. 6(B) is a sectional view of a B-B' portion of the line converter shown in FIG. 6(C), where the upper conductor plate is mounted on the line converter, as in the case of FIG. 6(A).

Here, reference numeral 1 denotes a lower conductor plate, reference numeral 2 denotes the upper conductor plate, and reference numeral 3 denotes a dielectric substrate. The dielectric substrate 3 is arranged so as to be sandwiched between the lower conductor plate 1 and the upper conductor plate 2.

FIG. 7 shows exploded plan views illustrating the configuration of each element and portion of the line converter. FIG. 7(A) shows the top surface of the upper conductor plate 2, FIG. 7(B) shows the top surface of the dielectric substrate 3, FIG. 7(C) shows a conductor pattern on the undersurface side of the dielectric substrate 3, and FIG. 7(D) is a plan view of the lower conductor plate 1.

Figure 7A:
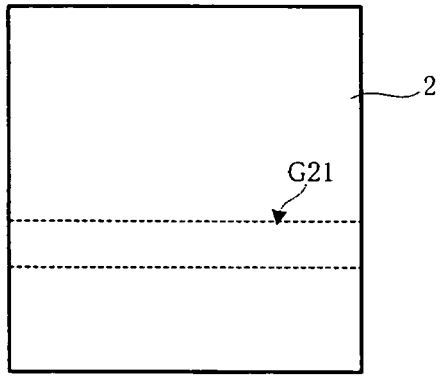
FIGS. 7(A)-7(D) show exploded plan views of the line converter.
Figure 7B:
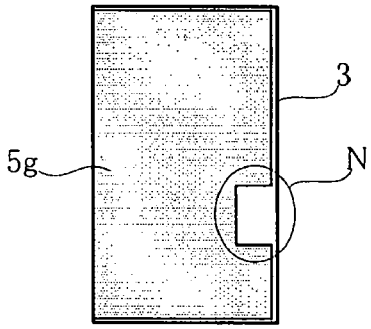
Figure 7C:
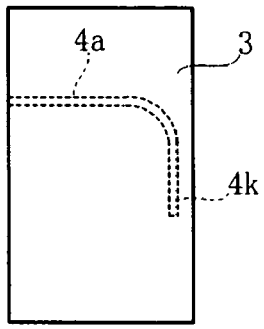
Figure 7D:
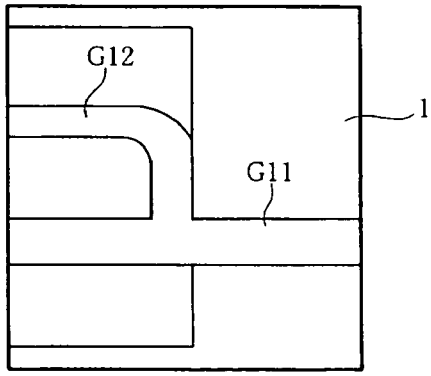

A three-dimensional-waveguide groove G11 is provided on the lower conductor plate 1 (FIG. 7(D)) and a three-dimensional-waveguide groove G21 is provided on the upper conductor plate 2 (FIG. 7(A)). By overlaying the two conductor plates 1 and 2 one another, the two three-dimensional-waveguide grooves are opposed to each other. Subsequently, the hollow rectangular waveguide tube (hereinafter simply referred to as a "waveguide tube") is formed.

Unlike the first preferred embodiment, the waveguide tube has a pass-through configuration in predetermined areas shown in FIGS. 6 and 7 so that no dielectric material is filled therein.

A predetermined plane of the waveguide tube is determined to be an E plane (a conductor plane that is substantially parallel to the electric field of a TE10 mode that is the mode of a propagating electromagnetic wave), where the E plane is substantially parallel to the lower conductor plate 1 and the upper conductor plate 2. Therefore, the dielectric substrate 3 is provided at a position that is substantially parallel to the E plane of the waveguide tube and that corresponds to the approximately central portion of the waveguide tube (a portion between the lower conductor plate 1 and the upper conductor plate 2).

A transmission-line conductor 4*a* and a coupling-line conductor 4*k* continuing therefrom are disposed on the undersurface of the dielectric substrate 3 (the side facing the lower conductor plate 1) (FIG. 7(C)). A ground conductor 5*g* is disposed on the top surface of the dielectric substrate 3 (the side facing the upper conductor plate 2) (FIG. 7(B)). The transmission-line conductor 4*a* disposed on the dielectric substrate 3 and the ground conductor 5*g* disposed on the plane facing the transmission-line conductor 4*a* define a micro-strip line. In this preferred embodiment, the ground conductor 5*g* is provided only on the top-surface side of the dielectric substrate 3.

A notch portion is formed in the ground conductor 5*g*, as indicated by reference character N shown in FIG. 7(B). The coupling-line conductor 4*k* facing the notch portion N, the dielectric substrate 3, the lower conductor plate 1, and the upper conductor plate 2 define a suspended line.

When the dielectric substrate 3 is sandwiched between the two conductor plates 1 and 2, as is the case with the first preferred embodiment, the dielectric substrate 3 is provided at a predetermined position with reference to the conductor plates 1 and 2 so that the coupling-line conductor 4*k* is inserted in the waveguide in a predetermined direction that is substantially perpendicular to the electromagnetic-wave-propagation direction of the waveguide tube. At the same time, the dielectric substrate 3 is provided at a predetermined position so that the ground conductor 5*g* is inserted in the approximately central portion of the waveguide tube, so as to be substantially parallel to the E plane. A waveguide-shield area of the waveguide is defined by a predetermined portion designated by reference character S shown in FIG. 6 of the ground conductor 5*g*. The portion indicated by reference character S is a conductor portion defining the shield area.

According to the above-described configuration, line conversion between the hollow waveguide tube and the plane circuit can be achieved.

Further, according to the first and second preferred embodiments, the coupling-line conductor, the transmission-line conductor, and the ground conductors are preferably located on the surfaces of the dielectric substrate 3. However, some or all the conductors may be disposed inside the dielectric substrate (internal layers).

Further, the dielectric-filled waveguide is preferably used in the first preferred embodiment, as the three-dimensional waveguide, and the hollow waveguide tube is preferably used in the second preferred embodiment, as the three-dimensional waveguide. However, a dielectric line including a dielectric strip sandwiched between parallel conductor planes may be formed. Particularly, a non-radiative dielectric line may be formed.

Next, the configuration of a high-frequency module according to a third preferred embodiment will be described with reference to FIG. 8.

Figure 8:
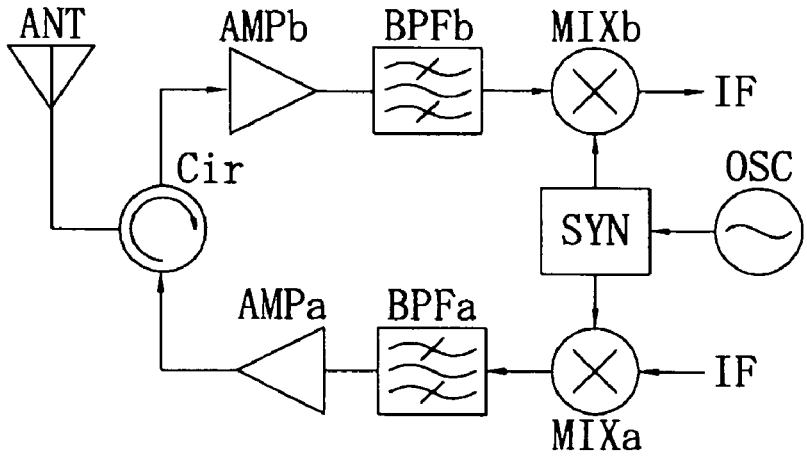
FIG. 8 is a block diagram illustrating a high-frequency module according to a third preferred embodiment of the present invention.

FIG. 8 is a block diagram showing the configuration of the high-frequency module according to the third preferred embodiment of the present invention.

In FIG. 8, reference characters ANT denote a transmission/reception antenna, reference characters Cir denote a circulator, each of reference characters BPFa and BPFb denotes a band-pass filter, each of reference characters AMPa and AMPb denotes an amplifier circuit, each of reference characters MIXa and MIXb denotes a mixer, reference characters OSC denote an oscillator, reference characters SYN denote a synthesizer, and reference characters IF denote an intermediate-frequency signal.

The MIXa mixes an input IF signal and a signal output from the SYN, the BPFa makes only a predetermined signal of the mixed output signals transmitted from the MIXa pass, where the predetermined signal corresponds to a transmission-frequency band. The AMPa amplifies the electrical power of the signal and transmits the signal from the ANT via the Cir. The AMPb amplifies reception signals taken from the Cir. The BPFb allows only a predetermined signal of the reception signals transmitted from the AMPb to pass, where the predetermined signal corresponds to a reception-frequency band. The MIXb mixes a frequency signal transmitted from the SYN and the reception signal, and outputs an intermediate-frequency signal IF.

A predetermined high-frequency component including the line converter according to the first preferred embodiment, or the second preferred embodiment can be used, as the amplifier circuits AMPa and AMPb shown in FIG. 8. That is to say, the dielectric-filled waveguide or the hollow waveguide is preferably used, as the transmission line, and the plane circuit including an amplifier circuit provided on the dielectric substrate is preferably used. By using the high-frequency component including the amplifier circuits and the line converter, a high-frequency module with a low loss and good communication performance is obtained.

Next, the configuration of a communication device according to a fourth preferred embodiment of the present invention will be described with reference to FIG. 9.

Figure 9:
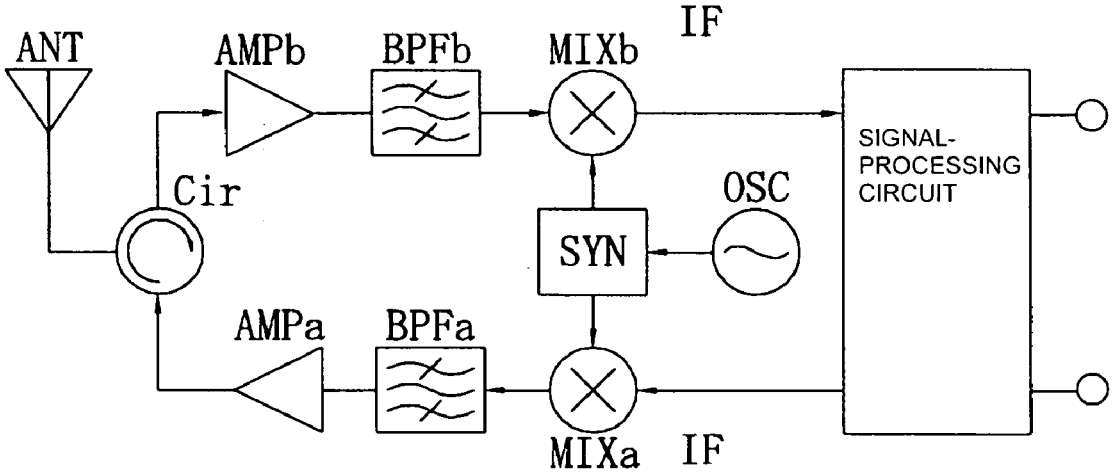
FIG. 9 is a block diagram illustrating a communication device according to a fourth preferred embodiment of the present invention.

FIG. 9 is a block diagram showing the configuration of the communication device according to the fourth preferred embodiment. The communication device preferably includes the high-frequency module shown in FIG. 8 and a predetermined signal-processing circuit. The signal-processing circuit shown in FIG. 9 includes an encoding-and-decoding circuit, a synchronization-control circuit, a modulator, a demodulator, a CPU, and so forth, and further includes a circuit for inputting and outputting transmission and reception signals to and from the signal-processing circuit. Thus, the communication device including the high-frequency module is provided and the high-frequency module is used as a unit for transmitting and receiving an electromagnetic wave.

Thus, by using the above-described line converter for performing line conversion between the three-dimensional waveguide and the plane circuit, and the high-frequency module using the line converter, a communication device with a low loss and good communication performance is provided.

As has been described above, various preferred embodiments of the present invention enable a shield area of a three-dimensional waveguide to be defined by using a conductor pattern of a dielectric substrate. Therefore, the positional relationship between a conductor portion on the dielectric-substrate side, where the conductor portion defines the shield area of the three-dimensional waveguide, and a coupling-line portion electromagnetically-coupled to a standing wave generated in the shield area can be determined only by the precision of forming the conductor pattern with reference to the dielectric substrate.

Subsequently, it becomes possible to obtain a stable coupling characteristic and a line-conversion characteristic according to a predetermined design, without being affected by the precision of assembling the three-dimensional waveguide and the plane circuit.

Further, according to various preferred embodiments of the present invention, the conductor portion defining the shield area includes ground conductors disposed on both surfaces of the dielectric substrate. Therefore, the shielding effect of the three-dimensional waveguide increases and the size of the line converter decreases.

Further, according to various preferred embodiments of the present invention, conduction is established between the ground conductors by using conduction paths. The conduction paths are formed on at least one of both sides of the transmission line, so as to be spaced away from the transmission line by as much as a predetermined distance and on both the surfaces of the dielectric substrate, so as to be arranged along the transmission line. Subsequently, the coupling line and the transmission line are hardly coupled with a spurious mode, so that a good spurious characteristic can be obtained.

Further, according to various preferred embodiments of the present invention, a space is provided in the conductor of the three-dimensional waveguide, so as to define a choke, where the space is provided at a predetermined distance from the three-dimensional waveguide, so as to be substantially parallel to the electromagnetic-wave propagation direction of the three-dimensional waveguide. Subsequently, where the two conductor plates are joined together and the three-dimensional waveguide is provided, the radiated electrical-power loss of the three-dimensional waveguide decreases.

Further, other preferred embodiments of the present invention provide a low-loss high-frequency module including a line converter and a high-frequency circuit connected to a plane circuit and a three-dimensional waveguide of the line converter.

Further, another preferred embodiment of the present invention provides a communication device with decreased losses caused by line conversion and a suitable communication characteristic.

As has been described, according to the line converter of various preferred embodiments of the present invention, the characteristic of coupling between the plane circuit and the three-dimensional waveguide that are provided on the dielectric substrate is not affected by the precision of assembling the plane circuit and the three-dimensional waveguide so that a line-conversion characteristic according to a predetermined design can be easily obtained. Therefore, the line converter can be used for a high-frequency module and a communication device used for at least one of a microwave band and a millimeter-wave band, for example.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

The invention claimed is:

1. A line converter comprising:

a three-dimensional waveguide arranged to propagate an electromagnetic wave in a three-dimensional space;

a dielectric substrate; and a plane circuit having a conductor pattern disposed on said dielectric substrate; wherein the dielectric substrate is arranged to be substantially parallel to an E plane of the three-dimensional waveguide and at an approximately central portion of the three-dimensional waveguide and the conductor pattern of the dielectric substrate includes a conductor portion defining a shield area of the three-dimensional waveguide, a coupling-line portion that is electromagnetically coupled to a standing wave that occurs in the shield area, and a transmission-line portion extending from the coupling-line portion.

2. The line converter according to claim 1, wherein the conductor portion includes ground conductors disposed on two surfaces of the dielectric substrate.

3. The line converter according to claim 2, further comprising a plurality of conduction paths that penetrates the dielectric substrate and that is aligned on at least one of two sides of the transmission-line portion, so as to be spaced away from the transmission line by as much as a predetermined distance, so that conduction is established between the ground conductors disposed on said two surfaces of the dielectric substrate.

4. A high-frequency module comprising the line converter according to claim 1 and a high-frequency circuit connected to each of the plane circuit and the three-dimensional waveguide of the line converter.

5. A communication device comprising the high-frequency module according to claim 4 provided in a unit for transmitting and receiving an electromagnetic wave.

6. The line converter according to claim 1, wherein the transmission-line portion includes a micro-strip line including a ground conductor disposed on one of the surfaces of the dielectric substrate and a line conductor disposed on the surface opposed thereto and on which the coupling-line portion is disposed to define a suspended line including the line conductor disposed on one of the surfaces of the dielectric substrate and the conductor of the three-dimensional waveguide.

7. A high-frequency module comprising the line converter according to claim 6 and a high-frequency circuit connected to each of the plane circuit and the three-dimensional waveguide of the line converter.

8. A communication device comprising the high-frequency module according to claim 7 provided in a unit for transmitting and receiving an electromagnetic wave.

9. The line converter according to claim 1, wherein a conductor of the three-dimensional waveguide is divided into two portions including an upper portion and a lower portion by a plane that is substantially parallel to the E plane and a space is provided in the conductor of the three-dimensional waveguide so as to create a choke defined by the space, where the space is provided at a position that is spaced away from the three-dimensional waveguide by as much as a predetermined distance, so as to be substantially parallel to an electromagnetic-wave propagation direction of the three-dimensional waveguide.

10. A high-frequency module comprising the line converter according to claim 9 and a high-frequency circuit connected to each of the plane circuit and the three-dimensional waveguide of the line converter.

11. A communication device comprising the high-frequency module according to claim 10 provided in a unit for transmitting and receiving an electromagnetic wave.

* * * * *